United States Patent [19]

Akiyama et al.

[11] 4,064,605

[45] Dec. 27, 1977

[54] METHOD FOR PRODUCING NON-WOVEN WEBS

[75] Inventors: Takashi Akiyama; Akinori Tanji; Hideo Ikeda; Seiichi Asano, all of Otsu, Japan

[73] Assignee: Toyobo Co., Ltd., Osaka, Japan

[21] Appl. No.: 717,927

[22] Filed: Aug. 26, 1976

[30] Foreign Application Priority Data

Aug. 28, 1975 Japan ..... 50-104800
Oct. 31, 1975 Japan ..... 50-131657

[51] Int. Cl.[2] ..... D04H 3/02; D02J 1/22

[52] U.S. Cl. ..... 28/103; 28/240; 28/271; 264/109; 425/66; 425/80

[58] Field of Search ..... 28/1 SM, 1.4, 71.3, 28/72.14, 72 NW, 103, 240, 271; 264/109, 290 R, 291; 425/66, 80; 226/7, 97

[56] References Cited

U.S. PATENT DOCUMENTS

| | | | |
|---|---|---|---|
| 3,341,912 | 9/1967 | Dyer et al. | 28/1.4 |
| 3,364,538 | 1/1968 | Murphy | 28/1 SM |
| 3,423,809 | 1/1969 | Schmitt | 28/72.12 |
| 3,662,440 | 5/1972 | Hill et al. | 28/72.12 |
| 3,694,872 | 10/1972 | Sundbeck | 28/71.3 |

*Primary Examiner*—Louis K. Rimrodt
*Attorney, Agent, or Firm*—Birch, Stewart, Kolasch and Birch

[57] ABSTRACT

A method for continuously producing a non-woven web having uniform distribution of filaments from natural or synthetic fibers comprising drafting with use of a high speed air-jet type drafting device a number of filaments which are fed from a filament source and blasting the drafted filaments onto a face of a moving collector, which is characterized in that the distribution of the filaments is controlled by passing the filaments through a filament distribution-controlling device comprising a filament guide passage having a narrow rectangular cross section and an air sucking means provided at least an one rectangular side wall of the filament guide passage, said controlling of the distribution of the filaments being performed with the air stream sucked spontaneously or positively from the air sucking means.

5 Claims, 17 Drawing Figures

METHOD FOR PRODUCING NON-WOVEN WEBS

BACKGROUND AND SUMMARY OF THE INVENTION

The present invention relates to a method for continuously producing a non-woven web from filaments of natural or synthetic fiber. More particularly, it relates to a method for continuously producing a non-woven web having uniform distribution of the filaments by drafting the filaments with a high speed air-jet type drafting device.

It is well known in the art to produce a non-woven web by means of an air-jet type drafting device (generally referred to as "air sucker"), drafting in high speed air flows a multiple number of filaments which are led from a filament source in the form of spinning nozzles or raw filaments on bobbins, and blasting the drafted yarns against a horizontally moving collector (normally, a wire mesh conveyor) which is located beneath the drafting device. The web producing method using as a filament source spinning nozzles each with a multiple number of orifices for melt-spinning and drafting the resultant synthetic fiber by an air sucker is known as a "spun bond method," which is generally favorably accepted because of uniform distribution of filaments in the web, high productivity and low production cost. However, with the recent extension of utilities of the non-woven webs as a base cloth in various industrial fields, there has been requested non-woven webs having a higher uniformity.

As an example of a device used for the spun bond method, i.e. for drafting filaments in the form of a curtain which are obtained by melt-spinning a synthetic resin through spinning nozzles having a multiple number of orifices, there has already been proposed a combination of an air jetting device, by which high speed air jets (compressed air) are once blasted from opposite sides onto the filaments in such a jetting angle that the component force of the air jets in the moving direction of the filaments becomes far larger than that in the right angle direction, and a filament-drafting device which is located beneath the air jetting device and is provided with narrow guide passages for guiding the filaments and air stream (Japanese Patent Publication No. 38,025/1973). In this method using the air jetting device and the filament-drafting device, the high speed air jets are applied to the filaments in the form of a curtain from opposite sides only one time in order to avoid the entanglement of the filaments. Any slight variation in the gap space of the air jet spouting slits of this device results in non-uniform blasting action of the air jets on the filaments and thus in non-uniform webs. Of course, it is technically possible to maintain a uniform gap at the respective jet spouting slits by resorting to an additional slit adjusting mechanism. However, high precision work is required in machining its respective component parts. This problem naturally will lead to high installation costs and maintenance expenses and are eventually reflected by higher production costs of the webs. Moreover, the guide passage for passing through of the filaments should also be provided in a highly precise dimension. Even if these parts of the device are provided in a highly precise dimension, the uniform distribution of the filaments is lost, for instance, by a slight variation of the conditions for cooling the filaments or by a small deposit onto the filament guide passage of the drafting device, and it is necessary to remove various causes of inducing such a non-uniformity of the filaments deposited on the collector, but it is very difficult.

The present inventors have intensively studied to find an improved method for producing a non-woven web having uniform distribution of the filaments by using the above device, and it has now been found that the desired web can be produced by drafting the filaments in the form of a curtain from a filament source with a high speed air-jet type drafting device via a filament distribution-controlling device equipped with a filament guide passage having a narrow rectangular cross section and plural sucking means which are provided at least at one rectangular side wall of the filament guide passage.

An object of the present invention is to provide an improved method for producing non-woven webs having uniform distribution of filaments.

Another object of the invention is to provide an improvement in the drafting of the filaments with a high speed air-jet type drafting device in order to avoid the non-uniformity of the filaments stream or the entanglement of the filaments.

A further object of the invention is to provide a filament distribution-controlling device for controlling the stream of the filaments drafted with a high speed air-jet type drafting deice.

These and other objects of the invention will be apparent from the following description.

The method for continuously producing non-woven webs having uniform distribution of filaments of the present invention comprises drafting filaments in the form of a curtain from a filament source with a high speed air-jet type drafting device via a filament distribution-controlling device and blasting the filaments thus drafted onto a collector.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
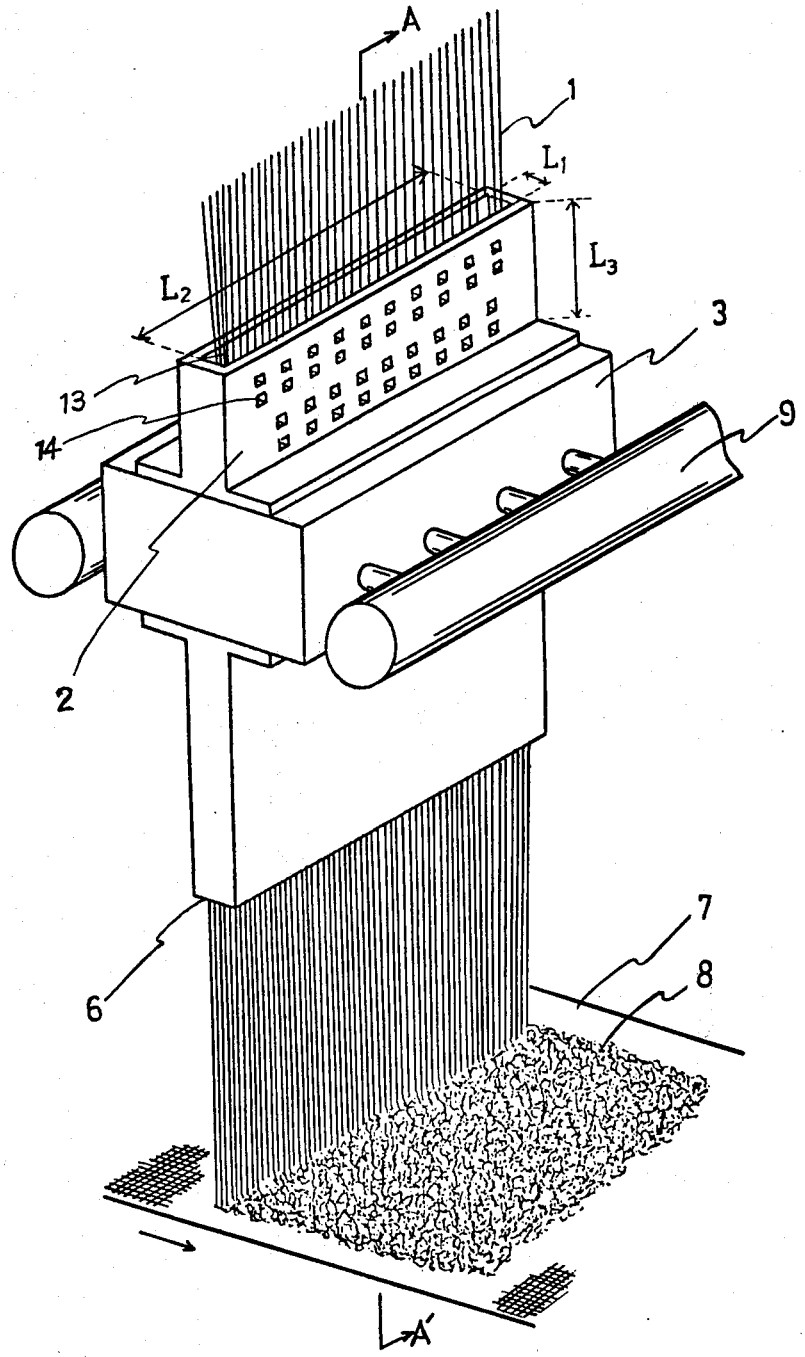
FIG. 1 is a perspective view of one embodiment of the device of the present invention.
Figure 2:
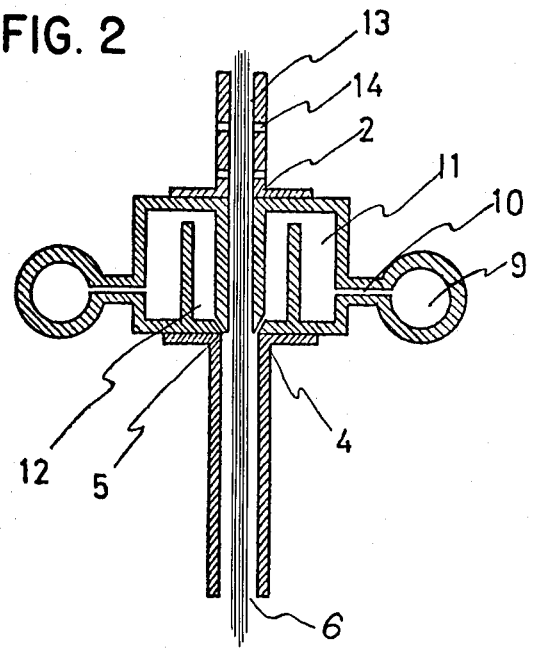
FIG. 2 is a sectional view taken along A—A of FIG. 1.

FIG. 1 is an oblique view of one embodiment of the device used in the present invention and showing the procedure of the production of non-woven webs using the device, and FIG. 2 is a sectional view through A — A' of FIG. 1. The filaments 1 obtained by spinning a synthetic resin through spinning nozzle each having plural orifices (not shown) are cooled at least until the surface of the filaments are solidified, and are introduced in the form of a curtain into a high speed air-jet type drafting device 3 via a filament distribution-controlling device 2. The drafting device 3 is equipped with a guide passage 4 having a narrow lectangular cross section, which is used for guiding the filaments in the form of a curtain, and a couple of air-jet spouting slits 5, through which air is jetted for drafting the filaments from opposite sides of the guide passage 4. The filaments drafted with the drafting device 3 are discharged from a discharge opening 6 of the drafting device 3, wherein the filaments are in the form of a curtain and are uniformly distributed, and then are deposited onto a collecting conveyor 7, which is moving at a constant speed, and thereby uniform webs 8 are produced.

In the production of non-woven webs by the present invention, there is preferably used as a filament source a spinneret for melt-spinning a thermoplastic high molecular compound such as polyolefins, polyamides and polyesters. The spinneret has preferably a plural number of orifices which are arranged, for instance, so as to be about 50 to 250 orifices in the width direction and about 4 to 15 rows in the depth direction within a rectangular cubic wall (the depth: about: 50 - 150 mm, the width: about 200 - 600 mm).

As is shown in FIGS. 1 and 2, the air-jet type drafting device 3 has preferably the guide passage 4 having a narrow rectangular section and the slits 5 for jetting compressed air at a high speed, in an acute angle and in the moving direction from opposite sides of the guide passage 4. The compressed air is supplied into the slits 5 from a compressed air supplier 9, in which the compressed air from the compressed air supplier 9 is firstly passed through a branched tube 10, introduced into a pressurized air room 11, passed through a stream regulating room 12 and then led to the slits 5. By the high speed air stream jetted from the slits 5, the filaments are drafted at a high speed, whereby the physical properties of the filaments are modified, and then the filaments are discharged together with the air stream from the discharge opening 6. Suitable speed of the compressed air jetted from the slits 5 may vary with the spinning speed of the filaments, but may usually be 100 to 800 m/second. Accordingly, all parts of the device should be composed of the material tolerant to such a high speed compressed air stream.

The filaments discharged together with air stream in the form of a curtain from the discharge opening 6 are deposited onto the collecting conveyor 7, which is moving at a constant speed, and thereby uniform webs 8 are formed. The collecting conveyor 7 comprises usually a wire mesh, so that the air discharged from the discharge opening 6 of the drafting device 3 can be passed through. An air sucking device is usually provided on the reverse side of the collecting conveyor 7 for preventing any disturbance of the webs 8 deposited on the conveyor 7 owing to the violent strike of the air stream thereon.

By the filament distribution-controlling device 2 provided on the drafting device 3, the filaments are uniformly discharged in the form of a curtain from the discharge opening 6. The filament distribution-controlling device 2 comprises a filament guide passage 13 having a narrow rectangular cross section and an air sucking means (in FIG. 1, holes 14) provided on the wall, and through the holes air is led into the passage 13. The filament distribution-controlling device 2 may be formed separately or in one body together with the drafting device 3. According to the action of the air supplied through the holes, even when the filaments are supplied in the non-uniform form, they are uniformly distributed.

The guide passage 13 of the filament distribution-controlling device 2 has a narrow rectangular cross section which has preferably the substantially same shape as that of the narrow section of the guide passage 4 of the drafting device 3, i.e. a narrow rectangular section of 2 to 20 mm in the width ($L_1$) and 50 to 600 mm in the length ($L_2$). The length ($L_3$) of the guide passage 13 in the direction for passing of the filaments is 20 to 150 mm.

Figure 3:
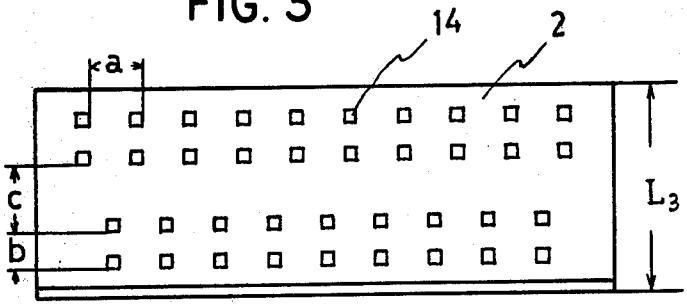
FIG. 3 shows a front view of the filament distribution-controlling device of FIG. 1.
Figure 4:
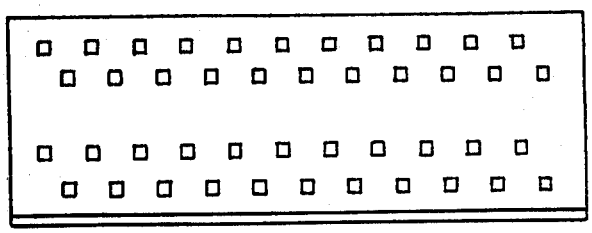
FIG. 4 shows a different arrangement of the square holes in the filament distribution-controlling device of FIG. 3.
Figure 5:
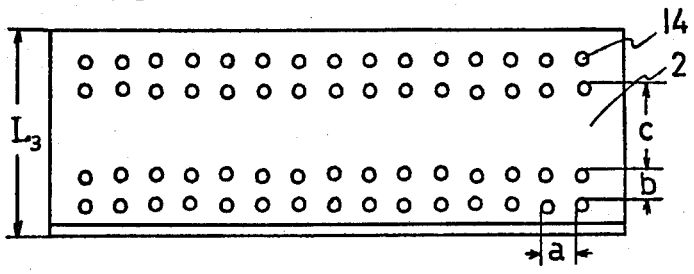
FIG. 5 shows the use of holes with a round shape in the filament distribution-controlling device.
Figure 6:
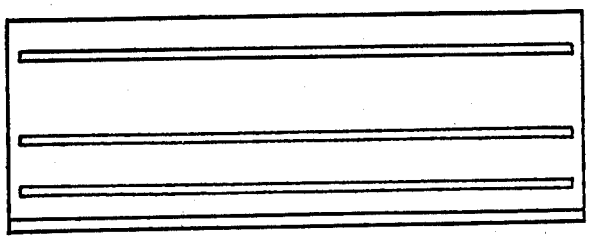
FIGS. 6, 7 and 8 show the air-sucking means in the form of slits, said slits being horizontally disposed in FIGS. 6 and 7 and perpendicularly disposed in FIG. 8.
Figure 7:
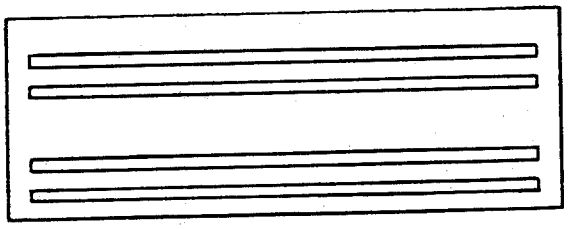
Figure 8:
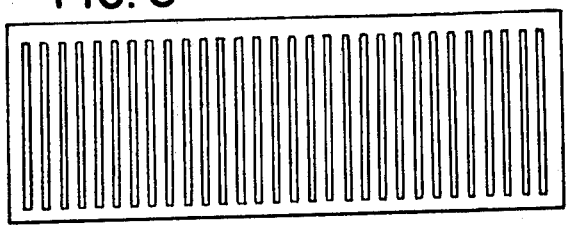
Figure 9:
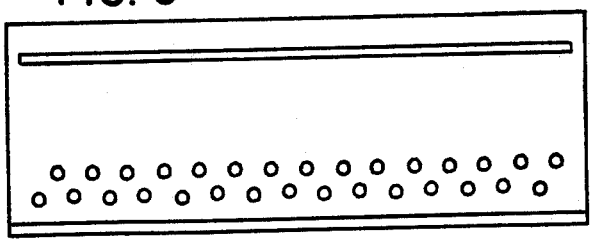
FIG. 9 shows the air-sucking means as a combination of a slit and round holes.

The air sucking means of the filament distribution-controlling device 2 may be in the various forms. One embodiment is shown in the accompanying FIG. 3, which is a front view of the filament distribution-controlling device 2 in FIG. 1, wherein plural square holes 14 are arranged. Other embodiments of the air sucking means are shown in the accompanying FIGS. 4 to 9 which are each a front view of the other embodiments of the filament distribution-controlling device useful in the present invention. In FIG. 4, the plural square holes 14 are arranged in a different way from that in FIG. 3. In FIG. 5, the holes are in a round shape. In FIGS. 6, 7 and 8, the air sucking means is in the form of a slit, said slit being formed horizontally in FIGS. 6 and 7 and being formed perpendicularly in FIG. 8, and in FIG. 9, the air sucking means is composed of a combination of the slit and the round shape holes.

When the air sucking means is in the square or round shaped holes, the holes are preferably in the same shape, have each an area of 0.5 to 100 mm$^2$, more preferably 0.8 to 30 mm$^2$, and are regularly arranged. For instance, as is shown in FIG. 3, the holes are arranged in a widthwise pitch (*a*) of 1 to 20 mm, more preferably 3 to 15 mm and in a longitudinal pitch (*b*) of 2 to 80 mm, more preferably 2 to 20 mm, and these holes thus arranged are put in two or more lines in the interval (i.e. the distance (*c*) in FIG. 3) of 20 to 80 mm. The holes may be arranged in an appropriate combination of the smaller pitch (*b*) and the larger pitch (*c*). When the air sucking means is in the slit form as shown in FIGS. 6, 7 and 8, the slit has preferably a width of 0.5 to 5 mm, more preferably 0.5 to 3 mm, and is arranged in two or more lines, wherein the distance between the lines is not specifically limited.

Figure 11:
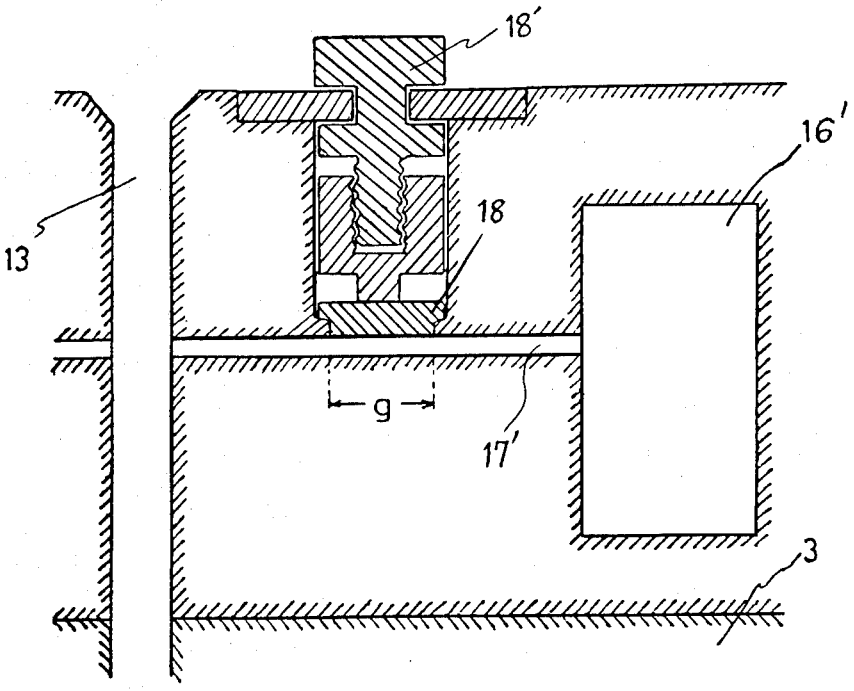
FIG. 11 shows another embodiment of the filament distribution-controlling device provided with an air supplier.
Figure 12A:
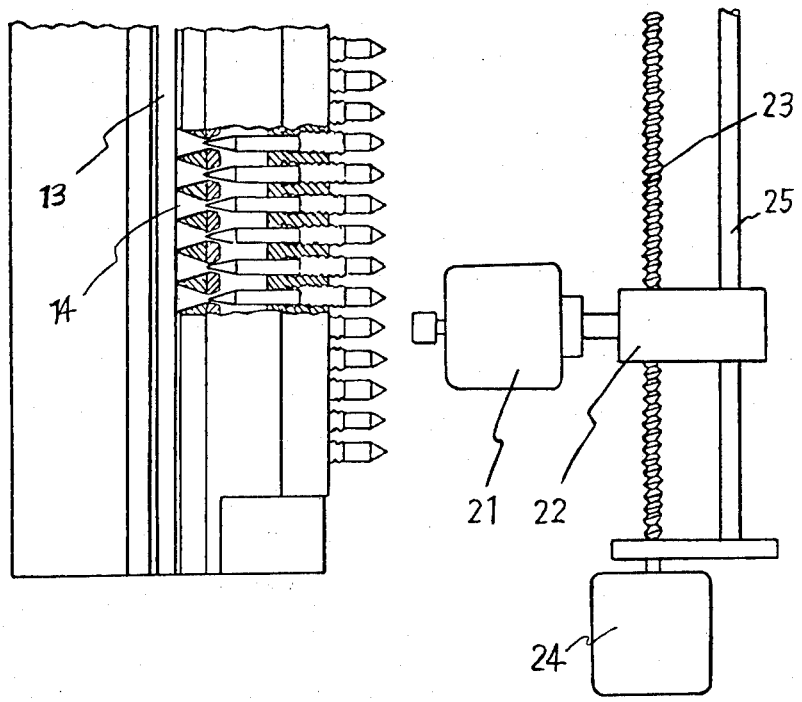
FIGS. 12(*a*) and 12(*b*) show a further embodiment of the filament distribution-controlling device provided with an air supplier.
Figure 12B:
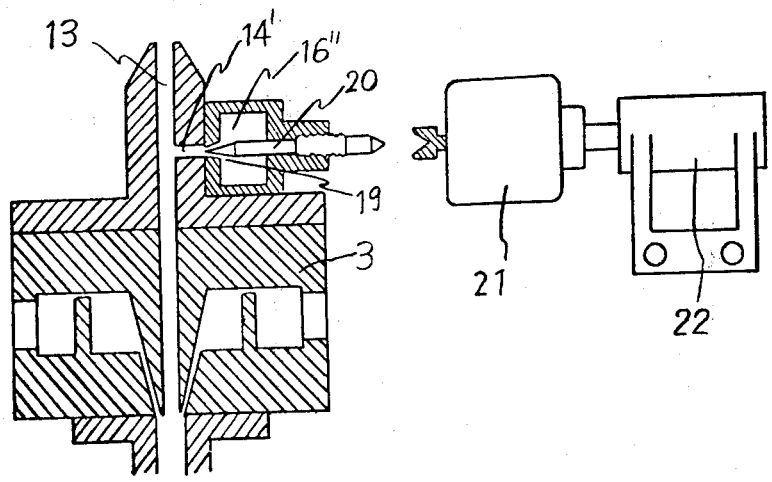

These holes or slits of the air sucking means may be provided perpendicularly to the filament guide passage 13, but are more preferably provided so as to incline into the passage 13. The sucking of air may spontaneously be effected by the action of the air stream jetted from the drafting device 3, but may be effected positively by supplying air from the air sucking means with an air supplier, as shown in the accompanying FIG. 10, which is a sectional view of another embodiment of the device used in the present invention corresponding to FIG. 2, wherein an air supplier is additionally provided with the filament distribution-controlling device. The air supplier is composed of a compressed air duct 16, a branched tube 17 and an air control means 18, wherein the compressed air from the duct 16 is passed through the branched tube 17 and is led to the air control means 18, and then the air is forcibly supplied from the air sucking means. Another embodiment of the filament distribution-controlling device provided with an air supplier is shown in FIG. 11, which is a sectional view thereof. In FIG. 11, the compressed air is supplied from the air duct 16' via a tube 17' into the filament guide passage 13, wherein the tube 17' is partially closed or narrowed by pushing a bolt 18' provided on an elastic molded belt type material 18. A further embodiment of the filament distribution-controlling device provided with an air supplier is shown in FIGS. 12(*a*) and 12(*b*), which are a plane view and a longitudinal sectional view thereof, respectively. In FIGS. 12(*a*) and 12(*b*), the compressed air is supplied from the air duct 16'' which is connected to the holes 14' into the filament guide passage 13. The air volume sucked is controlled at the air volume controlling passage 19 by closing or narrowing the passage 19 with a needle 20, which is moved forwardly or backwardly by rotating it with a controlling device, said controlling device comprising a servomotor 21 for rotating the needle 20, an air cylinder 22 for connecting the servomotor 21 with the needle 20, a screw 23 for scanning the air cylinder 22 and a servomotor 24 for positioning the screw 23 and a guide roll 25.

When a compressed air is positively supplied to the filament guide passage through the holes or slits of the air sucking means, the air volume is controlled with an appropriate means. For instance, when the air sucking means is non-continuous holes as shown in FIGS. 3, 4 and 5, the control of the air volume may be performed with a solenoid valve, a fluid control module or a needle valve. When the air sucking means is in the slit form as shown in FIGS. 6, 7 and 8, the air volume may be controlled by closing or opening partially or wholly the slits with the valve as mentioned above or by changing the sectional configuration of the air passing tube which is connected to the slits.

The air volume supplied to the filament guide passage through the air sucking means is not specifically restricted, but it is preferably supplied in a rate of $1.7 \times 10^{-2}$ to $27 \times 10^{-2}$ $m^3$/minute per the unit sectional area ($cm^2$) of the filament guide passage positioned lower than the air sucking means but higher than the slits 5 of the air jet type drafting device.

The filament distribution-controlling device 2 may be put on the drafting device 3, wherein the filament guide passage 13 of the filament distribution-controlling device is preferably joined to the filament guide passage 4 of the drafting device, but there may be provided a gap between both filament guide passages 13 and 4 and through the gap air is also sucked.

Figure 13:
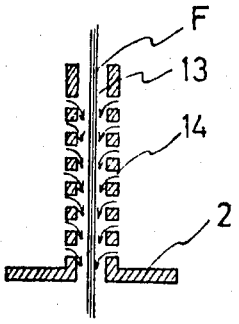
FIG. 13 shows a schematic longitudinal sectional view of the dilament distribution-controlling device.
Figure 14:
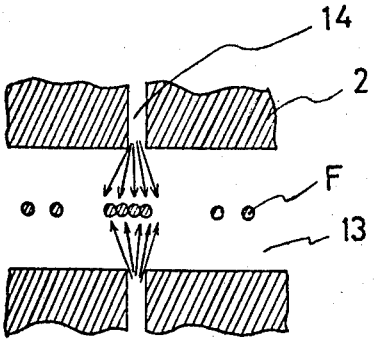
FIG. 14 is a schematic horizontal sectional view of the filament distribution-controlling device.

According to the present invention, the desired non-woven webs having uniform distribution of the filaments can be produced by the following mechanism. That is, owing to the aspiration effect of the compressed air jetted from the slits 5 of the drafting device 3, the pressure within the filament guide passage 13 of the filament distribution-controlling device 2 is reduced and hence a large volume of air is sucked from the upper inlet of the passage 13, and as the result, the filaments in the form of a curtain are sucked together with the accompanying air stream, wherein the pressure within the passage 13 is more reduced at the lower part. Thus, in the accompanying FIG. 13, which is a schematic longitudinal sectional view of the filament distribution-controlling device 2, the air suck from the holes or slits 14 into the filament guide passage 13 is performed weakly at the upper part of the device and is performed strongly at the lower part thereof. As is shown in the accompanying FIG. 14, which is a schematic horizontal sectional view of the filament distribution-controlling device 2, when the filaments F are partially drafted in the dense state, the dense filaments are uniformly diffused to become in the sparse state. Thus, when the filaments are in an unbalanced distribution owing to the spinning conditions and the action of the drafting device, the distribution of the filaments is regulated with the air stream sucked from the air sucking means during passing the filaments through the filament distribution-controlling device, and thereby, the filaments are drafted in the form of a curtain.

When the non-uniformity of the filaments in the width direction is larger, it is preferable to use the filament distribution-controlling device having many air sucking means at the lower part of the filament guide passage thereof, and on the other hand, when the non-uniformity of the filaments in the width direction is smaller, it is preferable to use the device having many air sucking means at the upper part of the passage. This control of the number of the air sucking means may be performed by closing or opening the desired part of the air sucking means in the same filament distribution-controlling device, for instance, by using a solenoid valve, or by using a cotton cloth, paper or the like.

Thus, according to the present invention, the desired non-woven webs having uniform distribution of filaments can be produced by providing a filament distributioncontrolling device having a simple structure on the air-jet type drafting device, and therefore, the method of the present invention is industrially useful.

It is known that some means are used for the similar purpose as in the present invention, for instance, a means for dividing the filaments (e.g. a filament guide) which is provided on the air-jet type drafting device, or an air-jet type drafting device being divided in the form like harmonica. However, these known means are not suitable for the production of the webs in an industrial scale, because it is very difficult to pass each filament through the predetermined individual passage, and when the number of the filaments is so many, it is substantially impossible, and further when a part of the filaments is cut during the operation of the device, the cut filament is wound and closes the filament passage and then the filament is passed through the adjacent filament passage, which results in the undesired non-uniformity of the distribution of filaments. On the other hand, according to the present invention, such defects are eliminated, because the stream of filaments is controlled by the air sucking means, contrary to the conventional device wherein the stream of the filaments is settled mechanically.

In the present invention, the filaments are formed to the webs without deterioration of the properties because they are not touched with the parts (e.g. guide) of the device as in the conventional method, and furthermore, the uniform distribution of the filaments can be easily performed with a simple mechanism and operation. Thus, the present invention can give the desired non-woven webs having excellent properties with a low cost.

The present invention is illustrated by the following Examples, but is not limited thereto.

In the following Examples and Comparative Examples, the widthwise uniformity of the web was determined by measuring the weight of 30 10 or 20 mm × 250 mm sample strips (10 mm × 250 mm in Example 1 and Comparative Example 1, and 20 mm × 250 mm in Examples 2 to 4 and Comparative Example 2) which were obtained from arbitrary portions of the web, the longer sides of each sample strip lying in the longitudinal direction of the web, and was expressed in terms of CV (coefficient of variance). The longitudinal uniformity of the web was determined by measuring the weights of 30 250 mm × 10 or 20 mm sample strips (250 mm × 10 mm in Example 1 and Comparative Example 1, and 250 mm × 20 mm in Examples 2 to 4 and Comparative Example 2) which were obtained also from arbitrary portions of the web but cutting the longer sides of each sample strip in the transverse direction of the web, and was likewise expressed in terms of CV.

EXAMPLE 1

Using a device as shown in FIG. 1, wherein the filament distribution-controlling device having the hole arrangement as shown in FIG. 5 (*a:* 5 mm, *b:* 10 mm, *c:* 50 mm, diameter of hole: 2 mm, $L_1$: 6 mm, $L_2$: 500 mm, $L_3$: 100 mm), polyethylene terephthalate having an intrinsic viscosity of 0.61 (measured in a mixed solvent of phenol : 1,1,2,2-tetrachloroethane = 6 : 4 by weight, at 30° C) was melt-spun at a temperature of 290° C and at a rate of 1,200 g/min through a spinning nozzle having a plural number of orifices (i.e. in total 800 orifices of 0.3 mm in diameter in 6 rows and longitudinally at a distance of 480 mm at maximum). The melt-spun filaments in the form of a curtain were led to the air-jet type drafting device 3 which was located beneath the spinning nozzle at a distance of 900 mm and was provided with a filament guide passage 4 (width: 500 mm, space: 6 mm) via the above filament distribution-controlling device 2, wherein the filaments were drafted by jetting a compressed air of 2.0 kg/cm²G and the distribution of the filaments was appropriately controlled. The drafted filaments were collected onto the wire mesh conveyor 7 which was located beneath and at a distance of 800 mm from the drafting device 3 and which was moving at a speed of 50 m/min. As the result, there was obtained a web having a width of 520 mm and basis weight of 45 g/m². The web showed a widthwise uniformity (CV) of 5.3% and a longitudinal uniformity (CV) of 4.4%.

COMPARATIVE EXAMPLE 1

The above Example 1 was repeated excepting that no filament distribution-controlling device was used. As the result, there was obtained a web having a width of 520 mm and basis weight of 45 g/m². The web showed widthwise and longitudinal uniformities (CV) of 11.7% and 5.0%, respectively, and a longitudinal strip was clearly observed with the naked eye.

EXAMPLE 2

Figure 10:
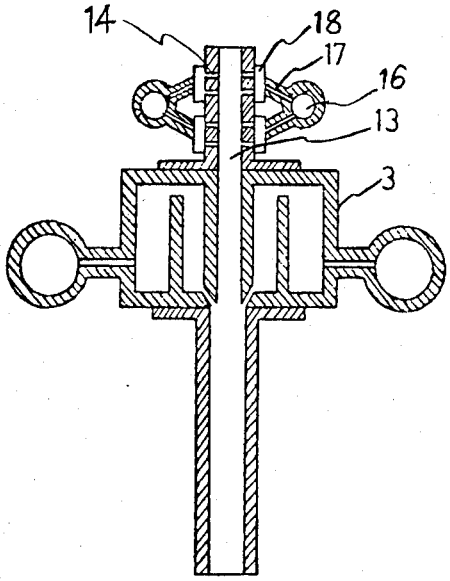
FIG. 10 is a sectional view of another embodiment of the device used in the present invention wherein an air supplier is provided with the filament distribution-controlling device.

By using the device as shown in FIG. 10 as the filament distribution-controlling device, which had the hole arrangement as shown in FIG. 5 (widthwise pitch *a:* 15 mm, longitudinal pitch *b:* 20 mm, *c:* 50 mm, diameter of hole: 2 mm, $L_1$: 6 mm, $L_2$: 500 mm, $L_3$: 100 mm, volume of the jetted air: 3 m³/min, pressure of jetted air: 0.1 kg/cm²G), polyethylene terephthalate having an intrinsic viscosity of 0.61 (measured in a mixed solvent of phenol : 1,1,2,2-tetrachloroethane = 6 : 4 by weight, at 30° C) was melt-spun at a temperature of 290° C and at a rate of 1,200 g/min through a spinning nozzle having a plural number of orifices (i.e. in total 800 orifices of 0.3 mm in diameter in 8 rows and longitudinally at a distance of 480 mm at maximum). The melt-spun filaments were led to the air-jet type drafting device 3 which was located beneath the spinning nozzle at a distance of 900 mm and was provided with a filament guide passage 4 (width: 500 mm, space: 6 mm) via the above filament distribution-controlling device 2, wherein the filaments were drafted by jetting a compressed air of 2.0 kg/cm²G. The drafted filaments were collected onto the wire mesh conveyor 7 which was located beneath and at a distance of 800 mm from the drafting device 3 and which was moving at a speed of 50 m/min. As the result, there was obtained a web having a width of 520 mm and basis weight of 45 g/m². The web showed a widthwise uniformity (CV) of 5.0% and a longitudinal uniformity (CV) of 4.5%.

COMPARATIVE EXAMPLE 2

The above Example 2 was repeated excepting that no filament distribution-controlling device was used. As the result, there was obtained a web having a width of 520 mm and basis weight of 45 g/m². The web showed widthwise and longitudinal uniformities (CV) of 11.7% and 5.0%, respectively, and a longitudinal strip was clearly observed with the naked eye.

EXAMPLE 3

In the same manner as described in Example 2, a web was produced by using the filament distribution-controlling device as shown in FIG. 11 having the arrangement of the air sucking means as shown in FIG. 7 (but it had only one slit). In FIG. 11, the filament guide passage 13 is connected with the air duct 16' via the slit-formed air passing tube 17' having a rectangular cross section. At the middle area on the tube 17', there is provided the elastic molded belt type material 18 which is laid in a belt type in the width direction of the drafting device 3. The elastic molded belt type material has the function of closing or narrowing partially the tube 17' by the action of the bolt 18' provided upper the belt type material. The belt type material 18 has a width (*g*) of 20 mm and a length of 500 mm which is the same as the width of the drafting device 3. On the belt type material, 25 bolts 18' are arranged at the interval of 20 mm in the longitudinal direction. The air passing tube 17' has a space of 2 mm. The filament distribution-controlling device 2 is provided on the drafting device 3 in one body.

Figure 15A:
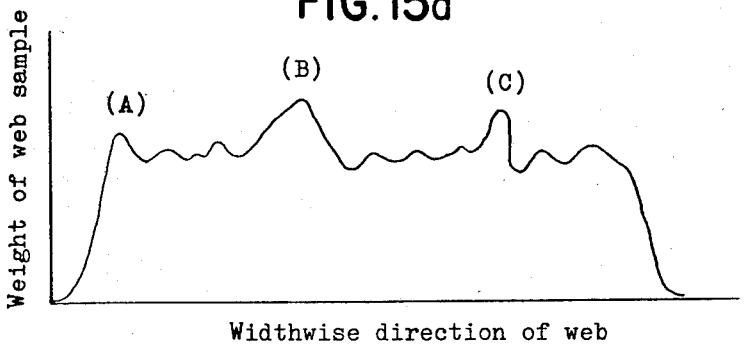
FIGS. 15*a* and 15*b* are graphic representations showing the weight distribution of the deposited filaments of a web.
Figure 15B:
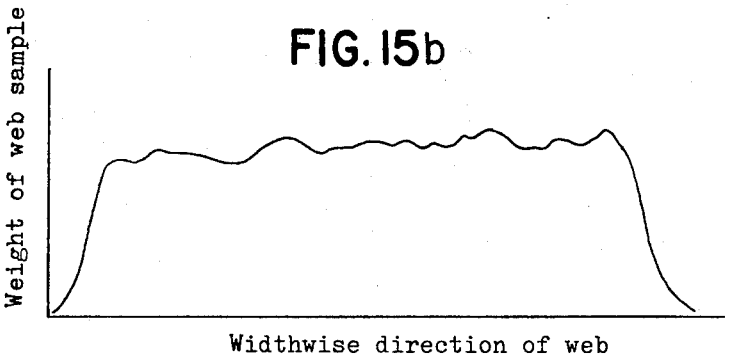

When the web was produced while whole of the slit was closed by pussing all of the bolts 18', there was obtained a web having a weight distribution of the deposited filaments as shown in FIG. 15(*a*) and the widthwise and longitudinal uniformities (CV) of 13.2% and 5.4%, respectively, wherein the weight distribution of the deposited filaments is shown in order of the portions of the web samples continuously obtained for the measurement of the uniformity thereof.

When the web was produced while openning the slit of the filament distribution-controlling device corresponding to the parts (A), (B) and (C) showing a larger weight distribution in FIG. 15(*a*), there was obtained a web having a weight distribution of the deposited filaments as shown in FIG. 15(*b*) and the widthwise and longitudinal uniformities (CV) of 3.8% and 5.2%, respectively.

EXAMPLE 4

In the same manner as described in Example 2, a web was produced by using the filament distribution-controlling device provided with an air supplier as shown in FIG. 12(*a*) and 12(*b*). In FIGS. 12(*a*) and 12(*b*), the filament guide passage 13 is connected with the air duct 16'' via the holes 14' and the air volume controlling passage 19, and the air volume sucked is controlled at the passage 19 by closing or narrowing the passage 19 with the needle 20. Each 40 holes 14', passages 19 and needles 20 are arranged within the width of 500 mm (the same of the width of the drafting device 3) at the interval of 12.5 mm. The filament distribution-controlling device is provided on the drafting device 3 in one body, wherein a controlling device is further provided, said controlling device comprising a servomotor 21 for rotating the needle 20, by which the needle is moved forwardly or backwardly, the air cylinder 22 for connecting the servomotor 21 with the needle 20, a screw 23 for scanning horizontally the air cylinder 22 in order to elect the optional needle among the 40 needles, and the servomotor 24 for positioning the screw 23 and the guide roll 25, and the device is operated with a control circuit which is provided at an appropriate position convenient for observing the distribution of the deposited filaments of the web.

When the web was produced while the air volume controlling passage 19 was wholly closed by pussing the needles 20, there was obtained a web having the widthwise and longitudinal uniformities (CV) of 13.4% and 5.3%, respectively.

When the web was produced while opening the holes of the filament distribution-controlling device 2 corresponding to the dense portions of the filaments in the produced web with observing thereof, there was obtained a web having the widthwise and longitudinal uniformities (CV) of 6.2% and 5.1%, respectively. When the arrangement of the holes opened were further controlled on the basis of the above result, there was obtained a web having better uniformities, i.e. having the widthwise and longitudinal uniformities (CV) of 4.8% and 5.0%, respectively.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for producing a non-woven web by drafting with the use of an air-jet type drafting device wherein a number of filaments which are fed from a filament source are blasted onto the face of a moving collector, said method comprising passing the filaments through a filament guide passage provided on the drafting device, said filament guide passage having a narrow rectangular cross section and supplying air through holes or slits provided on at least one side of the filament guide passage, whereby the distribution of the filaments is regulated with said air stream.

2. The method according to claim 1, wherein the air is supplied through a plurality of regularly arranged holes, each having an area of 0.5 to 100 $mm^2$.

3. The method according to claim 1, wherein the air is supplied through one or more slits having a width of 0.5 to 5 mm.

4. The method according to claim 1, wherein the air for regulating the distribution of the filaments is positively drawn through the holes or slits of the filament guide passage by the action of the air stream jetted from the air-jet type drafting device.

5. The method according to claim 1, wherein the air for regulating the distribution of the filaments is positively supplied through the holes or slits of the filament guide passage by an air supplier operatively associated with the filament distribution-controlling device.

* * * * *